US011878232B2

(12) United States Patent
Turkbas

(10) Patent No.: US 11,878,232 B2
(45) Date of Patent: Jan. 23, 2024

(54) MOUTHGUARD INCLUDING A PROTECTION PORTION HAVING HEATING AND SOFTENING FEATURES

(71) Applicant: Shock Doctor, Inc., Fountain Valley, CA (US)

(72) Inventor: Jay Turkbas, Hideout, UT (US)

(73) Assignee: Shock Doctor, Inc., Fountain Valley, CA (US)

( * ) Notice: Subject to any disclaimer, the term of this patent is extended or adjusted under 35 U.S.C. 154(b) by 44 days.

(21) Appl. No.: 17/691,936

(22) Filed: Mar. 10, 2022

(65) Prior Publication Data

US 2022/0193527 A1 Jun. 23, 2022

Related U.S. Application Data

(63) Continuation of application No. 16/363,860, filed on Mar. 25, 2019, now Pat. No. 11,273,360, which is a (Continued)

(51) Int. Cl.
*A63B 71/08* (2006.01)

(52) U.S. Cl.
CPC ..... *A63B 71/085* (2013.01); *A63B 2071/086* (2013.01)

(58) Field of Classification Search
CPC ..... A61C 19/063; A61C 7/125; A61C 5/90; A61C 7/08; A61C 7/10; A63B 2071/086; (Continued)

(56) References Cited

U.S. PATENT DOCUMENTS 1,146,264 A 7/1915 Kelly
1,505,642 A 8/1924 Henry
(Continued)

FOREIGN PATENT DOCUMENTS

AU 201305854 B2 * 5/2013
AU 2013205854 A1 3/2014
(Continued)

OTHER PUBLICATIONS

European Search Report issued in EP Application No. 14757382.6 dated Nov. 2, 2016, 9 pages.
(Continued)

*Primary Examiner* — Ophelia A Hawthorne
(74) *Attorney, Agent, or Firm* — FAEGRE DRINKER BIDDLE & REATH LLP

(57) ABSTRACT

A mouthguard according to an embodiment of the present disclosure includes an occlusion portion that is configured to be disposed between and engaged by at least some of the upper teeth and at least some of the lower teeth of a wearer. The mouthguard further includes a protection portion coupled to the occlusion portion. The protection portion is configured to be disposed laterally and anteriorly relative to the upper teeth of the wearer. The protection portion includes an interior surface that is configured to face toward the teeth of the wearer. The protection portion further includes an exterior surface opposite the interior surface and configured to face away from the teeth of the wearer. At least a portion of the exterior surface is a textured surface.

20 Claims, 11 Drawing Sheets

Related U.S. Application Data continuation of application No. PCT/US2016/054693, filed on Sep. 30, 2016.

(58) Field of Classification Search
CPC ..... A63B 71/085; A61F 5/566; A61F 5/56; Y10T 156/10
See application file for complete search history.

(56) References Cited

U.S. PATENT DOCUMENTS 1,569,947 A 1/1926 Buttress
1,720,439 A 7/1929 Richardson
2,312,171 A 2/1943 Jochum
2,444,294 A 6/1948 Jones
2,521,039 A 9/1950 Carpenter
2,827,899 A 3/1958 Domenico
2,966,908 A 1/1961 Cathcart et al.
3,073,300 A 1/1963 Berghash
3,089,487 A 5/1963 Enicks et al.
3,103,217 A 9/1963 Butler et al.
3,207,153 A 9/1965 Goldstein
3,223,085 A 12/1965 Gores et al.
3,228,107 A 1/1966 Zandberg
3,234,942 A 2/1966 Simor
3,236,235 A 2/1966 Jacobs
3,247,844 A 4/1966 Berghash
3,312,218 A 4/1967 Jacobs
3,333,582 A 8/1967 Cathcart
3,411,501 A 11/1968 Greenberg
D212,848 S 12/1968 Westlund
3,496,936 A 2/1970 Gores
3,505,995 A 4/1970 Greenberg
3,692,025 A 9/1972 Greenberg
3,768,465 A 10/1973 Helmer
3,788,314 A 1/1974 Noreen
3,878,610 A 4/1975 Coscina
RE28,667 E 12/1975 Gores
D263,073 S 2/1982 Jonkers et al.
D268,962 S 5/1983 Adams et al.
D273,527 S 4/1984 Pota
4,495,945 A 1/1985 Liegner
4,568,280 A 2/1986 Ahlin
4,610,743 A 9/1986 Salmeen et al.
4,944,947 A 7/1990 Newman
4,977,905 A 12/1990 Kittelsen et al.
5,031,638 A 7/1991 Castaldi
5,063,940 A 11/1991 Adell et al.
5,078,367 A 1/1992 Simpson et al.
5,117,816 A 6/1992 Shapiro et al.
D328,494 S 8/1992 Schwendeman et al.
D328,965 S 9/1992 Ewing
5,165,424 A 11/1992 Silverman
5,259,762 A 11/1993 Farrell
5,277,203 A 1/1994 Hays
5,293,880 A 3/1994 Levitt
5,336,086 A 8/1994 Simmen et al.
5,339,832 A 8/1994 Kittelsen et al.
5,406,963 A 4/1995 Adell
5,566,683 A 10/1996 Thornton
5,611,355 A 3/1997 Hilsen
5,642,737 A 7/1997 Parks
D382,965 S 8/1997 Wagner
5,692,523 A 12/1997 Croll et al.
5,693,523 A 12/1997 Watanabe et al.
5,826,581 A 10/1998 Yoshida
5,842,860 A 12/1998 Funt
D406,647 S 3/1999 Wagner
D414,281 S 9/1999 Sassenberg
5,970,981 A 10/1999 Ochel
6,036,487 A 3/2000 Westerman
6,068,475 A 5/2000 Stoyka, Jr.
6,082,363 A 7/2000 Washburn
6,280,196 B1 8/2001 Berghash
D452,011 S 12/2001 Redhage
6,405,729 B1 6/2002 Thornton
6,450,167 B1 9/2002 David et al.
6,491,036 B2 12/2002 Cook
6,494,210 B1 12/2002 Mams
6,584,978 B1 7/2003 Brett et al.
6,691,710 B2 2/2004 Kittelsen et al.
D492,785 S 7/2004 Garabito
D493,578 S 7/2004 Manzo et al.
6,978,786 B2 12/2005 Sabbagh
D525,749 S 7/2006 Manzo et al.
D526,093 S 8/2006 Manzo et al.
D527,848 S 9/2006 Manzo et al.
D530,863 S 10/2006 Manzo et al.
D537,986 S 3/2007 Manzo et al.
D537,987 S 3/2007 Manzo et al.
D538,926 S 3/2007 Jeong et al.
D539,429 S 3/2007 Wong
D541,481 S 4/2007 Farrell
7,210,483 B1 5/2007 Lesniak et al.
D548,402 S 8/2007 Trodick
7,299,804 B2 11/2007 Kittelsen et al.
D593,714 S 6/2009 Hirshberg
7,549,423 B1 6/2009 Hirshberg
D603,101 S 10/2009 Hirshberg
7,658,193 B2 2/2010 Lesniak
D611,658 S 3/2010 Manzo
D614,304 S 4/2010 Jansheski
D615,709 S 5/2010 Manzo
D616,152 S 5/2010 Manzo
D618,399 S 6/2010 Manzo
7,775,214 B1 8/2010 Lesniak et al.
D623,357 S 9/2010 Manzo et al.
D626,292 S 10/2010 Farrell
D627,107 S 11/2010 Manzo et al.
D630,382 S 1/2011 Manzo et al.
D630,860 S 1/2011 Sichel
D634,480 S 3/2011 Manzo et al.
D636,074 S 4/2011 Levine
7,954,496 B2 6/2011 Jansheski et al.
D641,478 S 7/2011 Belvedere et al.
D642,277 S 7/2011 Farrell
D644,791 S 9/2011 Petrocelli
8,033,392 B1 10/2011 Gehner et al.
D648,900 S 11/2011 Manzo
D649,252 S 11/2011 Spainhower
D652,576 S 1/2012 Farrell
D654,595 S 2/2012 Farrell
8,116,854 B2 2/2012 Hart et al.
D658,813 S 5/2012 Manzo
D663,485 S 7/2012 Turkbas et al.
D663,486 S 7/2012 Turkbas et al.
8,235,052 B2 8/2012 Maurello
D688,832 S 8/2013 Polk, III
D693,966 S 11/2013 Hanson
8,607,798 B2 12/2013 Turkbas et al.
D710,506 S 8/2014 Tolentino et al.
8,800,184 B1 8/2014 Lerman et al.
D714,066 S 9/2014 Thuma et al.
D727,571 S 4/2015 Brett et al.
D728,162 S 4/2015 Gottsch
D743,107 S 11/2015 Hirshberg
D743,108 S 11/2015 Charlton
D760,889 S 7/2016 Evans et al.
D765,919 S 9/2016 Croll
D782,743 S 3/2017 Engel et al.
9,622,837 B2 4/2017 Jansheski
D795,501 S 8/2017 Levine
D797,379 S 9/2017 Patel et al.
D799,049 S 10/2017 Farrell
D800,317 S 10/2017 Farrell
D804,043 S 11/2017 Gildersleeve
D804,829 S 12/2017 Austin
D807,583 S 1/2018 Evans
D814,053 S 3/2018 Darrow et al.
D816,210 S 4/2018 Gerschman et al.
D830,001 S 10/2018 Turkbas
D830,002 S 10/2018 Turkbas
D830,640 S 10/2018 Supple
D833,681 S 11/2018 Tolentino et al.
D834,258 S 11/2018 Turkbas

(56) References Cited

U.S. PATENT DOCUMENTS

| | | | | |
|---|---|---|---|---|
| D853,043 | S | 7/2019 | Turkbas | |
| D857,998 | S | 8/2019 | Turkbas | |
| 11,273,360 | B2 * | 3/2022 | Turkbas | A63B 71/085 |
| 2003/0075184 | A1 | 4/2003 | Persichetti | |
| 2003/0136416 | A1 | 7/2003 | White | |
| 2003/0205234 | A1 | 11/2003 | Bardach et al. | |
| 2004/0076219 | A1 | 4/2004 | Madison et al. | |
| 2004/0110111 | A1 | 6/2004 | Wasylucha | |
| 2004/0146836 | A1 | 7/2004 | Andersen | |
| 2004/0146837 | A1 | 7/2004 | Andersen | |
| 2004/0154626 | A1 | 8/2004 | Washburn et al. | |
| 2005/0019524 | A1 | 1/2005 | Kershaw | |
| 2007/0084471 | A1 | 4/2007 | Napoli et al. | |
| 2007/0151567 | A1 | 7/2007 | Maurello | |
| 2007/0151568 | A1 | 7/2007 | Maurello | |
| 2007/0235039 | A1 | 10/2007 | Gottsch | |
| 2008/0113143 | A1 | 5/2008 | Taylor | |
| 2008/0295850 | A1 * | 12/2008 | Lesniak | A61F 5/566 523/109 |
| 2009/0038624 | A1 | 2/2009 | Akervall et al. | |
| 2010/0051038 | A1 | 3/2010 | Quigless | |
| 2010/0055233 | A1 | 3/2010 | Macinnis et al. | |
| 2010/0304338 | A1 | 12/2010 | Cramer et al. | |
| 2011/0005531 | A1 | 1/2011 | Manzo | |
| 2011/0114100 | A1 | 5/2011 | Alvarez et al. | |
| 2011/0186055 | A1 | 8/2011 | Makkar et al. | |
| 2011/0214478 | A1 | 9/2011 | Hennig et al. | |
| 2011/0230587 | A1 | 9/2011 | Macinnis et al. | |
| 2012/0017922 | A1 | 1/2012 | Hirshberg | |
| 2012/0085354 | A1 | 4/2012 | Polk, III | |
| 2012/0090625 | A1 | 4/2012 | Evans et al. | |
| 2012/0111343 | A1 | 5/2012 | Turkbas et al. | |
| 2012/0174932 | A1 | 7/2012 | Wilson | |
| 2013/0052613 | A1 | 2/2013 | Chetiar et al. | |
| 2013/0068237 | A1 | 3/2013 | Herman et al. | |
| 2013/0074850 | A1 | 3/2013 | Lenart | |
| 2013/0087157 | A1 | 4/2013 | Hawkins | |
| 2013/0104913 | A1 | 5/2013 | Evans et al. | |
| 2013/0291874 | A1 | 11/2013 | Engel | |
| 2014/0090655 | A1 | 4/2014 | Robinson | |
| 2014/0093836 | A1 | 4/2014 | Wolpo | |
| 2014/0166024 | A1 | 6/2014 | Davidson et al. | |
| 2014/0238416 | A1 | 8/2014 | Lin | |
| 2014/0238417 | A1 | 8/2014 | Turkbas | |
| 2014/0238418 | A1 | 8/2014 | Turkbas | |
| 2014/0261465 | A1 | 9/2014 | Turkbas | |
| 2014/0345626 | A1 | 11/2014 | Brett et al. | |
| 2014/0352704 | A1 * | 12/2014 | Farrell | A63B 71/085 128/862 |
| 2016/0001160 | A1 | 1/2016 | Engel | |
| 2017/0120135 | A1 | 5/2017 | Engel et al. | |
| 2017/0172717 | A1 | 6/2017 | Deng et al. | |
| 2017/0312613 | A1 | 11/2017 | Wright | |
| 2018/0014912 | A1 | 1/2018 | Radmand | |
| 2018/0256388 | A1 | 9/2018 | Magistro | |
| 2019/0282886 | A1 | 9/2019 | Turkbas | |
| 2020/0323678 | A1 | 10/2020 | Fallon et al. | |

FOREIGN PATENT DOCUMENTS

| | | | |
|---|---|---|---|
| GB | 2491183 | A | 11/2012 |
| WO | 2014/093850 | A1 | 6/2014 |

OTHER PUBLICATIONS

Extended European Search Report issued in EP application No. 14756802.6, dated Oct. 31, 2016, 10 pages.

Gel Max Mouthguard,earliest comment Aug. 26, 2015, [online], [site visited Apr. 13, 2018], Retrievedfrom url:https://www.shockdoctor.com/gel-max-mouthguard (Year: 2015).

Gel Max Power Mouthguard, earliest comment Oct. 9, 2017, [online], [site visited Apr. 13, 2018]. Retrieved from url:https://www.shockdoctor.com/gel-max-power-mouthguard (Year: 2017).

Honeycomb Tower, Suzane Alward, Compulsive Art Tendencies Revealed, Mar. 2, 2014, [online], [site visited Apr. 16, 2018]. Retrieved from url:https://suzannealward.wordpress.com/2014/03/02/honeycomb-tower/ (Year: 2014).

Honeycomb wallpaper, no date available, [online], [site visited Apr. 13, 2018]. Retrieved from url:http://eskipaper.com/noneycomb-wallpaper-3.html#gal_post_73869_honeycomb-wallpaper-3.jpg (Year: 2018).

International Preliminary Report on Patentability received for PCT Patent Application No. PCT/US2016/054693, dated Apr. 11, 2019, 12 pages.

International Search Report and Written Opinion issued in PCT/US2014/018755, dated May 22, 2014, 8 pages.

International Search Report and Written Opinion issued in PCT/US2014/018756, dated Jun. 3, 2014, 11 pages.

International Search Report and Written Opinion received for PCT Patent Application No. PCT/US2016/054693, dated Jul. 24, 2017, 15 pages.

Shock Doctor Max Airflow Football Mouthguard (2016 Version), www.shockdoctor.com/max-airflow-mouthguard-2016 accessed May 9, 2018, at least available in Apr. 2016.

Shock Doctor Ultra Double Braces Mouthguard, www.shockdoctor.com/ultra-double-braces-mouthguard, accessed Jan. 24, 2017, at least available on Apr. 10, 2016.

Shock Doctor Ultra2 STC Mouthguard, www.shockdoctor.com/ultra2-slc-mouthguard, accessed Jan. 24, 2017, at least available on Apr. 10, 2016.

Shock Doctor Women's SuperFit Basketball Mouthguard, no date available, [online], [site visited Mar. 18, 2019]. Retrieved from url: https://www.dickssportinggoods.com/p/shock-doctor-womens-superfit-basketb-all-mouthguard-17skrwsprftbbllwmspm/17skrwsprftb-bllwmspm (Year: 2019).

SuperFit Basketball Mouthguard, earliest comment Jul. 17, 2017, [online], [site visited Apr. 13, 2018], Retrieved from urLhttps://www.shockdoctor.com/superfit-basketball-mouthguard-9200 (Year: 2017).

U.S. Appl. No. 29/610,727 entitled Mouthguard, filed Jul. 14, 2017.

U.S. Appl. No. 29/610,733 entitled Mouthguard, filed Jul. 14, 2017.

U.S. Appl. No. 29/629,798 entitled Mouthguard, filed Dec. 15, 2017.

U.S. Appl. No. 29/629,806 entitled Moutguard, filed Dec. 15, 2017.

* cited by examiner

MOUTHGUARD INCLUDING A PROTECTION PORTION HAVING HEATING AND SOFTENING FEATURES

CROSS-REFERENCE TO RELATED APPLICATIONS

This application is a continuation of U.S. application Ser. No. 16/363,860, with a filing date of Mar. 25, 2019, issued as U.S. Pat. No. 11,273,360 on Mar. 15, 2022, which is a continuation of International Application No. PCT/US2016/054693, with an international filing date of Sep. 30, 2016, which are incorporated by reference herein in their entireties.

TECHNICAL FIELD

The present invention relates to mouthguards for protecting a wearer's mouth during physical activities. More specifically, the present invention relates to mouthguards that are heated to facilitate fitting the mouthguard to the wearer's mouth.

BACKGROUND

Mouthguards are typically used to protect a wearer's teeth, oral tissue, and gums from impact and abrasion. Mouthguards may reduce the chance of shock and other injuries resulting from impacts during athletic activities. Some mouthguards are heated to facilitate fitting the mouthguard to the wearer's mouth, which increases wearer comfort and/or mouthguard effectiveness.

SUMMARY

In a first example, a mouthguard according to the present disclosure includes an occlusion portion configured to be disposed between and engaged between at least some of the teeth of a wearer. The mouthguard further includes a protection portion coupled to the occlusion portion. The protection portion is configured to be disposed laterally and anteriorly relative to the teeth of the wearer. The protection portion includes an interior surface that is configured to face toward the teeth of the wearer. The protection portion further includes an exterior surface opposite the interior surface and configured to face away from the teeth of the wearer. At least a portion of the exterior surface is a textured surface.

In a second example, the textured surface of the first example comprises a plurality of recesses.

In a third example, the plurality of recesses of the second example each comprise at least one of a diamond shape, a hexagon shape, a square shape, and a circle shape.

In a fourth example, another portion of the exterior surface of any of the preceding examples is a smooth surface.

In a fifth example, the smooth surface of any of the preceding examples is a first smooth surface, and the exterior surface comprises: a left posterior portion comprising the first smooth surface; a right posterior portion comprising a second smooth surface; and an anterior portion coupling the left posterior portion to the right posterior portion, the anterior portion comprising the textured surface.

In a sixth example, the protection portion of any of the preceding examples further comprises a plurality of through holes extending from the interior surface to the exterior surface.

In a seventh example, at least some of the plurality of through holes of any of the preceding examples are arranged in a row.

In an eighth example, at least some of the plurality of through holes of any of the preceding examples are arranged in a column.

In a ninth example, the plurality of through holes of any of the preceding examples comprises: a first row of through holes; and a second row of through holes disposed inferiorly to the first row of through holes.

In a tenth example, the occlusion portion of any of the preceding examples comprises: a base comprising a first material having a first hardness; and a bite layer coupled to the base and configured to be engaged by at least some of the upper teeth of the wearer, the bite layer comprising a second material having a second hardness, the second hardness being less than the first hardness.

In an eleventh example, the protection portion of any of the preceding examples has a first thickness between the interior surface and the exterior surface, the bite layer has a second thickness extending in a superior-inferior direction, and the first thickness is greater than the second thickness.

In a twelfth example, the first thickness of any of the preceding examples is in a range from 150 percent to 50 percent greater than the second thickness.

In a thirteenth example, the bite layer of any of the preceding examples is a superior bite layer, and the occlusion portion further comprises an inferior bite layer coupled to the base and configured to be engaged by at least some of the lower teeth of the wearer, the inferior bite layer comprising a third material having a third hardness, the third hardness being less than the first hardness.

In a fourteenth example, the protection portion of any of the preceding examples has a first thickness between the interior surface and the exterior surface, the superior bite layer has a second thickness extending in a superior-inferior direction, and the first thickness is greater than the second thickness.

In a fifteenth example, the first thickness of any of the preceding examples is in a range from 150 percent to 50 percent greater than the second thickness.

In a sixteenth example, the inferior bite layer of any of the preceding examples has a third thickness extending in a superior-inferior direction, and the first thickness is greater than the third thickness.

In a seventeenth example, wherein the first thickness of any of the preceding examples is in a range from 150 percent to 50 percent greater than the third thickness.

In an eighteenth example, wherein the textured surface of any of the preceding examples has a first waviness height, the smooth surface has a second waviness height, and the second waviness height is less than the first waviness height.

In a nineteenth example, wherein the first waviness height of any of the preceding examples is greater than or equal to 0.3 mm and the second waviness height is less than 0.3 mm.

In a twentieth example, wherein the exterior surface of any of the preceding examples has an open area percentage, the open area percentage being a percentage of the total area of the through holes to the total area of the exterior surface, including the through holes, and the open area percentage being in a range from 15 percent to 1 percent.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
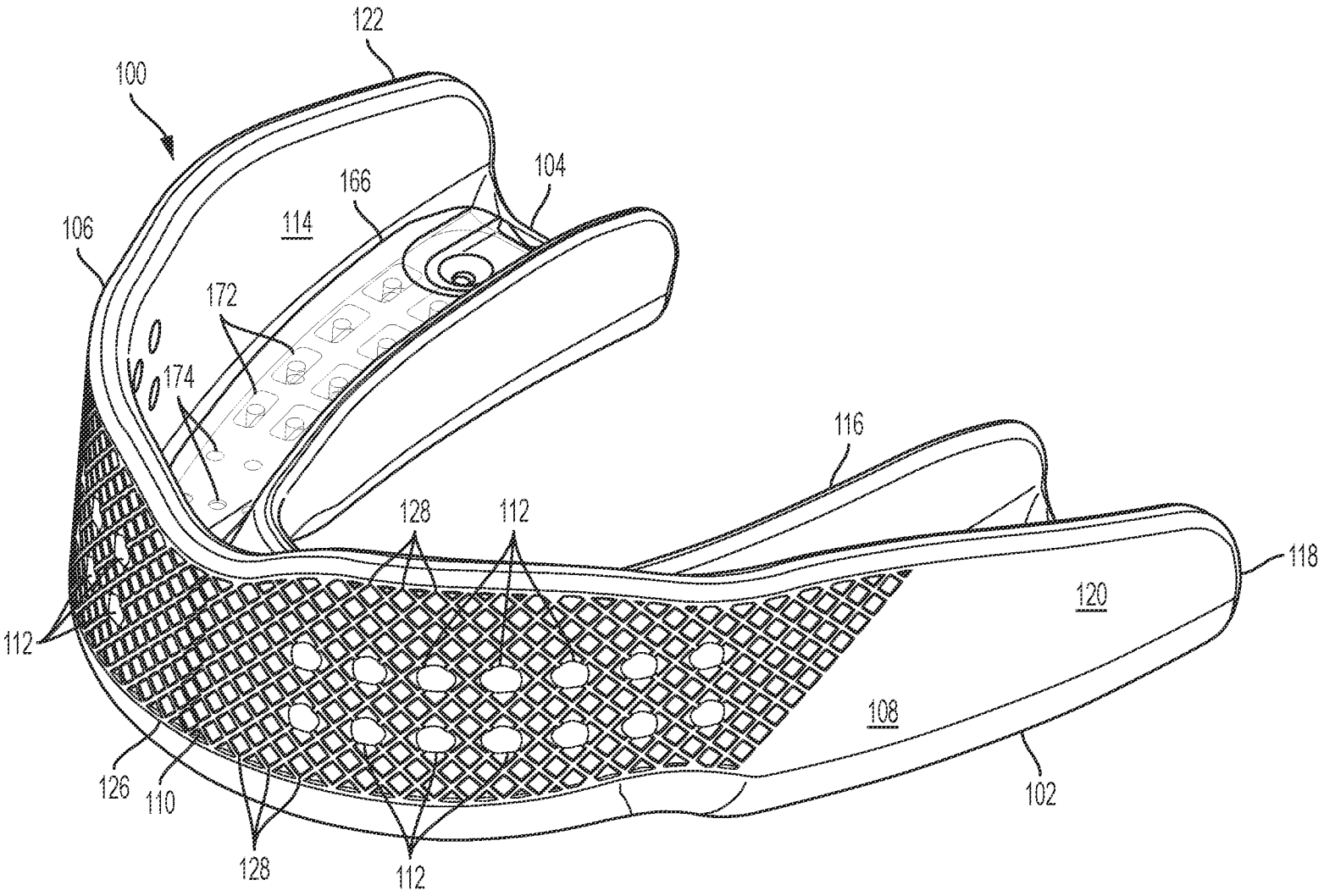
FIG. 1 is a perspective view of a mouthguard, according to some embodiments of the present disclosure.
Figure 2:
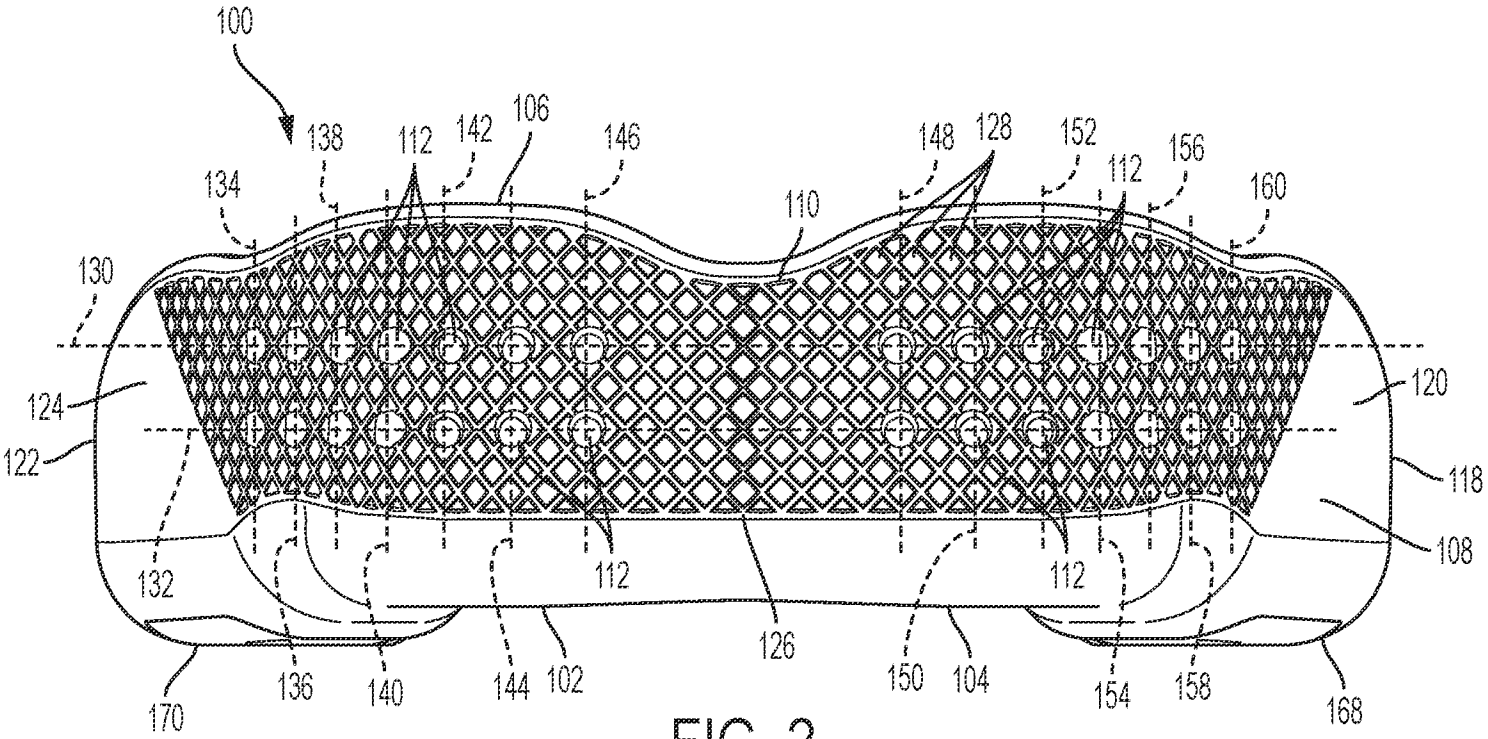
FIG. 2 is a front view of the mouthguard of FIG. 1.

It should be understood that the drawings are intended facilitate understanding of exemplary embodiments of the present invention are not necessarily to scale.

DETAILED DESCRIPTION

The following description refers to the accompanying drawings which show specific embodiments. Although specific embodiments are shown and described, it is to be understood that additional or alternative features are employed in other embodiments. The following detailed description is not to be taken in a limiting sense, and the scope of the claimed invention is defined by the appended claims and their equivalents.

It should be understood that like reference numerals are intended to identify the same structural components, elements, portions, or surfaces consistently throughout the several drawing figures, as such components, elements, portions, or surfaces may be further described or explained by the entire written specification, of which this detailed description is an integral part. Unless otherwise indicated, the drawings are intended to be read (for example, cross-hatching, arrangement of parts, proportion, degree, etc.) together with the specification, and are to be considered a portion of the written description. In the description, the terms "superior", "inferior", "anterior", "posterior", "medial", and "lateral", as well as variations thereof (for example, "superiorly" and the like) are used to describe relative positions of features of mouthguards. Such terms refer to anatomical reference directions when a mouthguard is positioned in a wearer's mouth in a typical orientation. Specifically, "superior" refers to a direction extending from the feet toward the head, "inferior" refers to a direction extending from the head toward the feet, "anterior" refers to a direction extending from the back of the head to the eyes, "posterior" refers to a direction extending from the eyes to the back of the head, "medial" refers to directions extending from the right shoulder to the base of the neck or from the left shoulder to the base of the neck, and "lateral" refers to directions extending from the base of the neck toward the right shoulder or from the base of the neck to the left shoulder.

FIGS. 1-7 illustrate a mouthguard 100 according to some embodiments of the present disclosure. Generally, the mouthguard 100 includes a base 102 that defines, at least in part, an occlusion portion 104. When placed in a wearer's mouth, the occlusion portion 104 is configured to be disposed between and engaged between at least some of the teeth of the wearer. The occlusion portion 104 couples to a protection portion 106. When the mouthguard 100 is placed in the wearer's mouth, the protection portion 106 is configured to be disposed laterally and anteriorly relative to the wearer's teeth. The protection portion 106 may be a relatively thick structure (for example, compared to other structures of the mouthguard 100 or other mouthguards) to facilitate protecting the teeth. The protection portion 106 also includes features that facilitate quickly heating and softening the relatively thick structure in a "boil-and-bite" fitting method. Stated another way, the protection portion 106 includes features that facilitate softening the relatively thick structure in about the same amount of time as the rest of the mouthguard 100, or one or more portions of the mouthguard 100 to be fitted to the wearer's mouth (for example, the occlusion portion 104). This inhibits the rest of the mouthguard 100, or the one or more portions of the mouthguard 100 to be fitted to the wearer's mouth, from over-softening and losing structural integrity while heating. Illustratively, the protection portion 106 includes an exterior surface 108 (that is, a surface that faces away from the wearer's teeth), at least a portion of which is a rough or textured surface 110 (that is, a non-smooth surface). The protection portion 106 also includes a plurality of through holes 112 that extend from the exterior surface 108 to an interior surface 114 of the protection portion 106 (that is, a surface that faces toward the wearer's teeth). The textured surface 110 and the through holes 112 provide the protection portion 106 with a relatively large surface area, which facilitates relatively quickly heating and softening the protection portion 106. These and other aspects of the mouthguard 100 are described in further detail below.

The base 102 defines the occlusion portion 104, and the protection portion 106 is disposed anteriorly and laterally relative to the occlusion portion 104. The base 102 also defines an inner portion 116 coupled to the occlusion portion 104. The inner portion 116 is disposed posteriorly, superiorly, and medially from the occlusion portion 104. In some embodiments, the base 102 monolithically defines the occlusion portion 104, the protection portion 106, and the inner portion 116. Exemplary materials for the base 102 are described below.

In some embodiments and as shown in the figures, the protection portion 106 is configured to be disposed anteriorly and laterally relative to, and thereby protect, the upper teeth of the wearer. In some embodiments, the protection portion 106 is configured to be disposed anteriorly and laterally relative to, and thereby protect, the lower teeth of the wearer.

In some embodiments, the textured surface 110 defines the entirety of the exterior surface 108 of the protection portion 106. In some embodiments, the textured surface 110 defines less than the entirety of the exterior surface 108 of the protection portion 106. As a specific example and as shown in the figures, the exterior surface 108 includes a left posterior portion 118 that includes a first smooth surface 120, a right posterior portion 122 that includes a second smooth surface 124, and an anterior portion 126 that couples the left posterior portion 118 to the right posterior portion 122 and includes the textured surface 110.

The textured surface 110 may include a variety of features to provide its textured structure. For example, the textured surface 110 may include a plurality of protrusions (not shown) or, as shown in the figures, a plurality of recesses 128. In some embodiments, the textured surface includes about 300 recesses 128 (that is, 300 recesses 128±10 percent). In some embodiments, the recesses 128 each have diamond shapes (when viewing the exterior surface 108 perpendicularly thereto), although other shapes are also contemplated. Other exemplary shapes for the recesses 128 are described in further detail below. In some embodiments, the recesses 128 have curved interior surfaces. In some embodiments, the recesses 128 have flat interior surfaces with perpendicularly extending side walls. In some embodiments, the recesses 128 each have a height (in a superior-inferior direction) of about 1.6 mm (that is, 1.6 mm±0.3 mm), a width (perpendicular to the height and along the exterior surface 108) of about 1.6 mm (that is, 1.6 mm±0.3 mm), and/or a depth (perpendicular to both the height and the width) of about 0.5 mm (that is, 0.5 mm±0.2 mm).

In some embodiments and as shown in the figures, the through holes 112 may have circular cross-sectional shapes. For example, circular through holes 112 could each have a diameter of about 2.00 mm (that is, 2.00 mm±0.25 mm), about 1.50 mm (that is, 1.50 mm±0.25 mm), or about 1.00 mm (that is, 1.00 mm±0.25 mm). It is contemplated that the through holes 112 could have other cross-sectional shapes (such as triangular shapes, rectangular shapes, diamond shapes, pentagon shapes, hexagon shapes, oval shapes, and the like) and various sizes.

The through holes 112 may provide the exterior surface 108 with various open area percentages (that is, a percentage of the total area of the through holes 112 to the total area of the exterior surface 108, including the through holes 112). For example, the exterior surface 108 may have an open area percentage in a range from 15 percent to 1 percent, a range from 6 percent to 2 percent, or a range from 4 percent to 3 percent.

The through holes 112 may be arranged in one or more rows (that is, disposed in one or more medially-laterally extending planes) and/or one or more columns (disposed in one or more superiorly-inferiorly extending planes). As a specific example and referring specifically to FIG. 2, the through holes 112 may be arranged in a first row 130 and a second row 132 that is disposed inferiorly to the first row 130. The rows may be spaced apart on the exterior surface 108, for example, by a distance that is two times the diameter of the through holes 112. In addition, pairs of through holes 112, one hole 112 of each pair being in the first row 130 and the other hole 112 being in the second row 132, are arranged in 14 columns 134, 136, 138, 140, 142, 144, 146, 148, 150, 152, 154, 156, 158, and 160. The columns, except for the seventh column 146 and eighth column 148, may be spaced apart on the exterior surface 108, for example, by a distance that is two times the diameter of the through holes 112. The seventh column 146 and eighth column 148 may be spaced apart on the exterior surface 108, for example, by a distance that is eight times the diameter of the through holes 112. Other arrangements of the through holes 112 are also contemplated. For example, in some embodiments only some through holes 112 are arranged in rows and/or columns. As another example, in some embodiments none of the through holes 112 are arranged in rows or columns.

Figure 3:
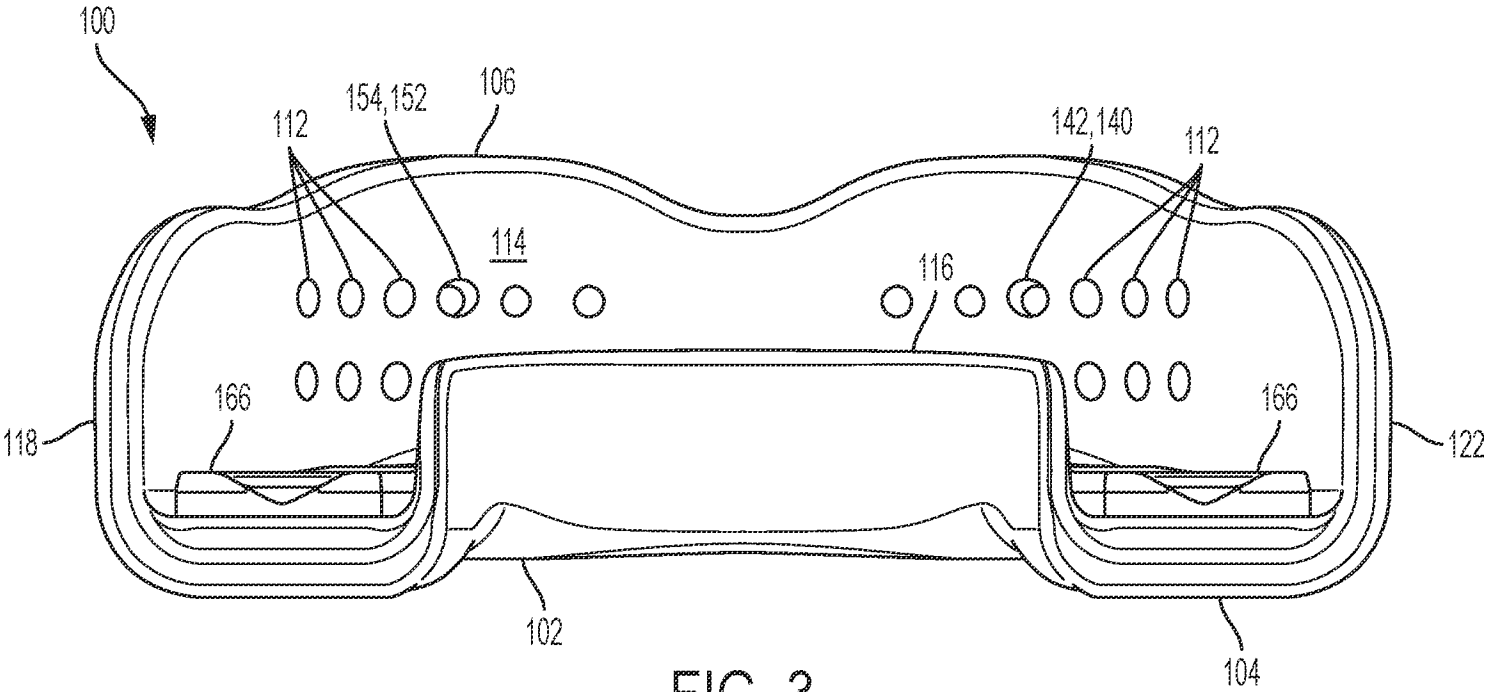
FIG. 3 is a back view of the mouthguard of FIG. 1.
Figure 4:
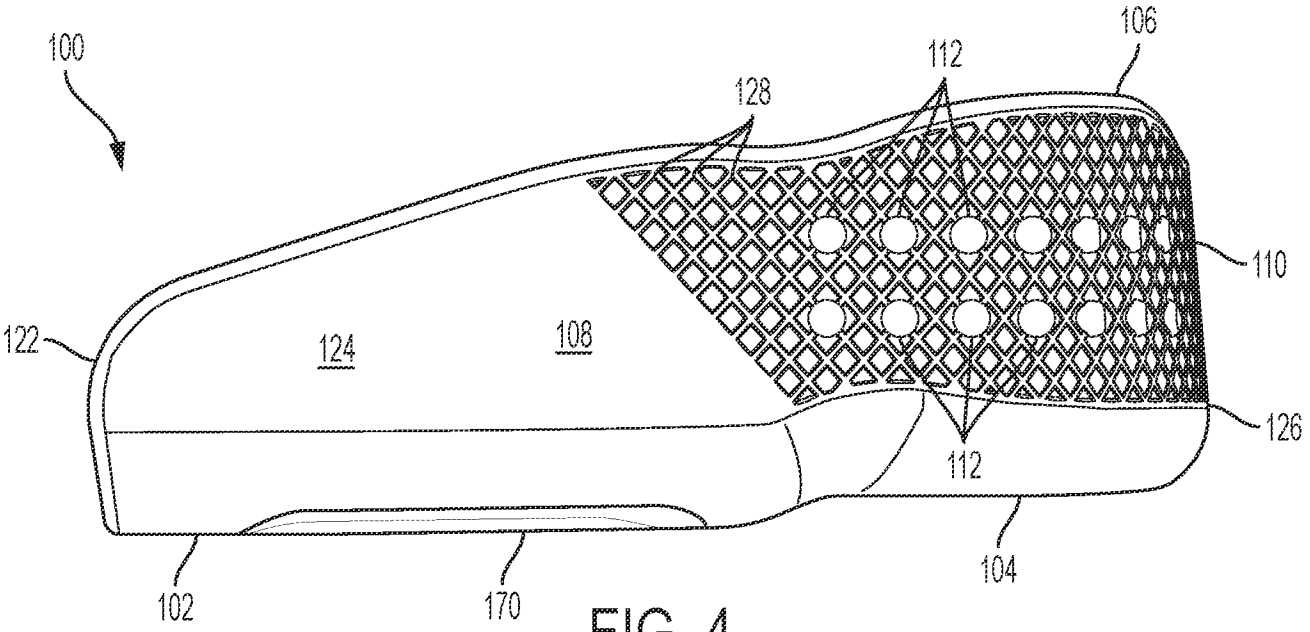
FIG. 4 is a left side view of the mouthguard of FIG. 1.
Figure 5:
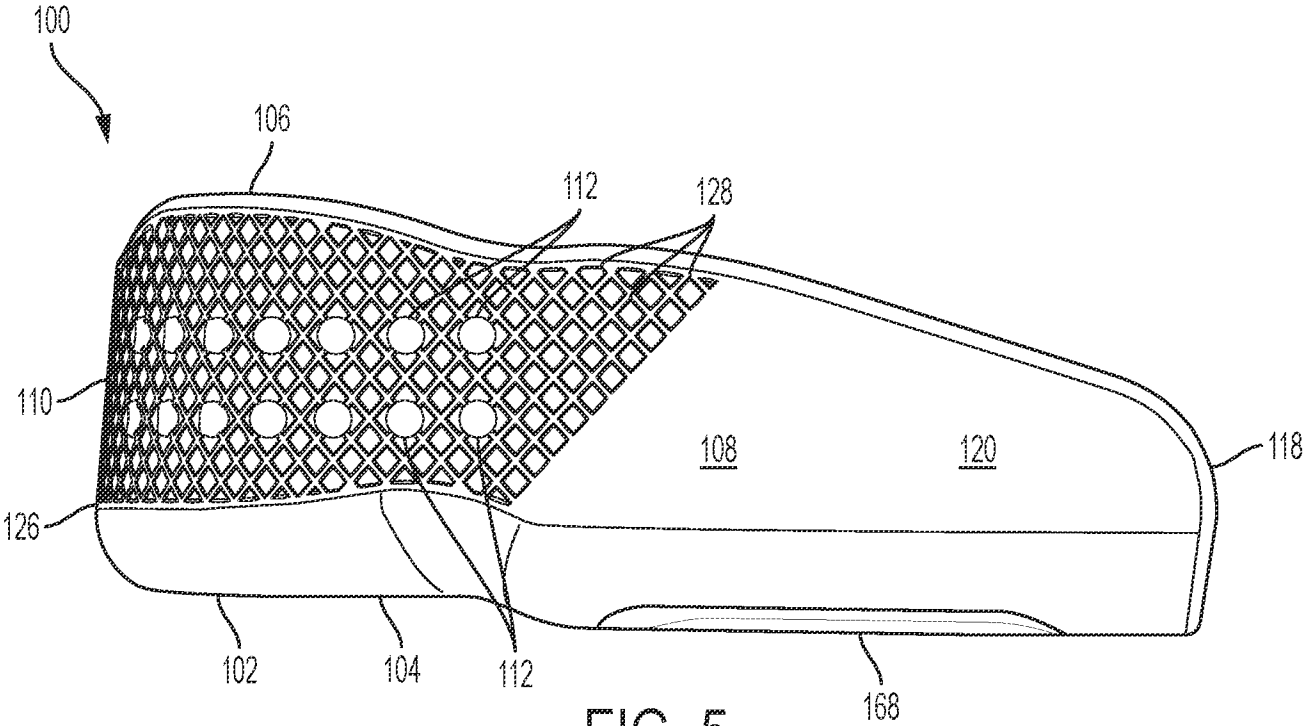
FIG. 5 is a right side view of the mouthguard of FIG. 1.
Figure 6:
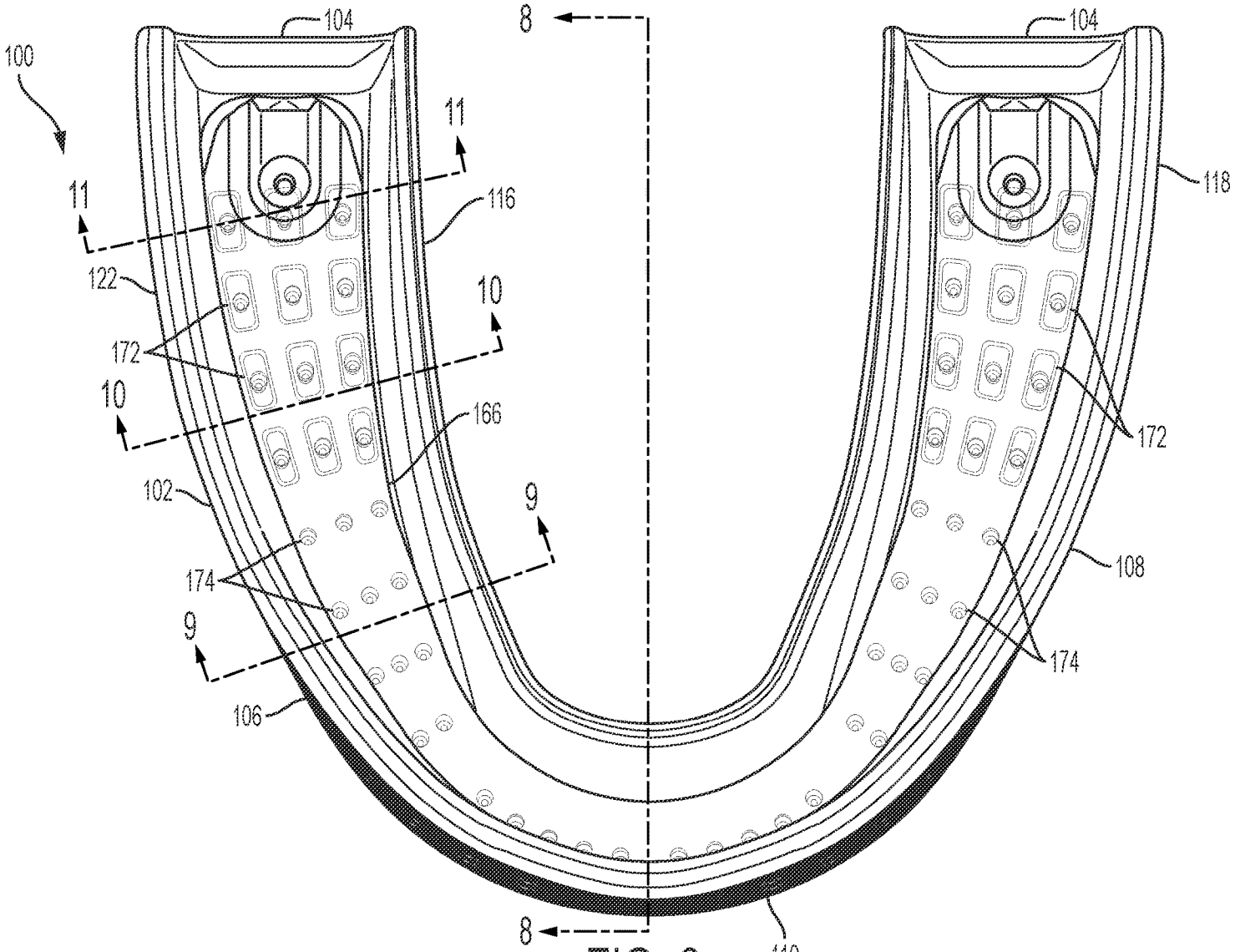
FIG. 6 is a top view of the mouthguard of FIG. 1.
Figure 7:
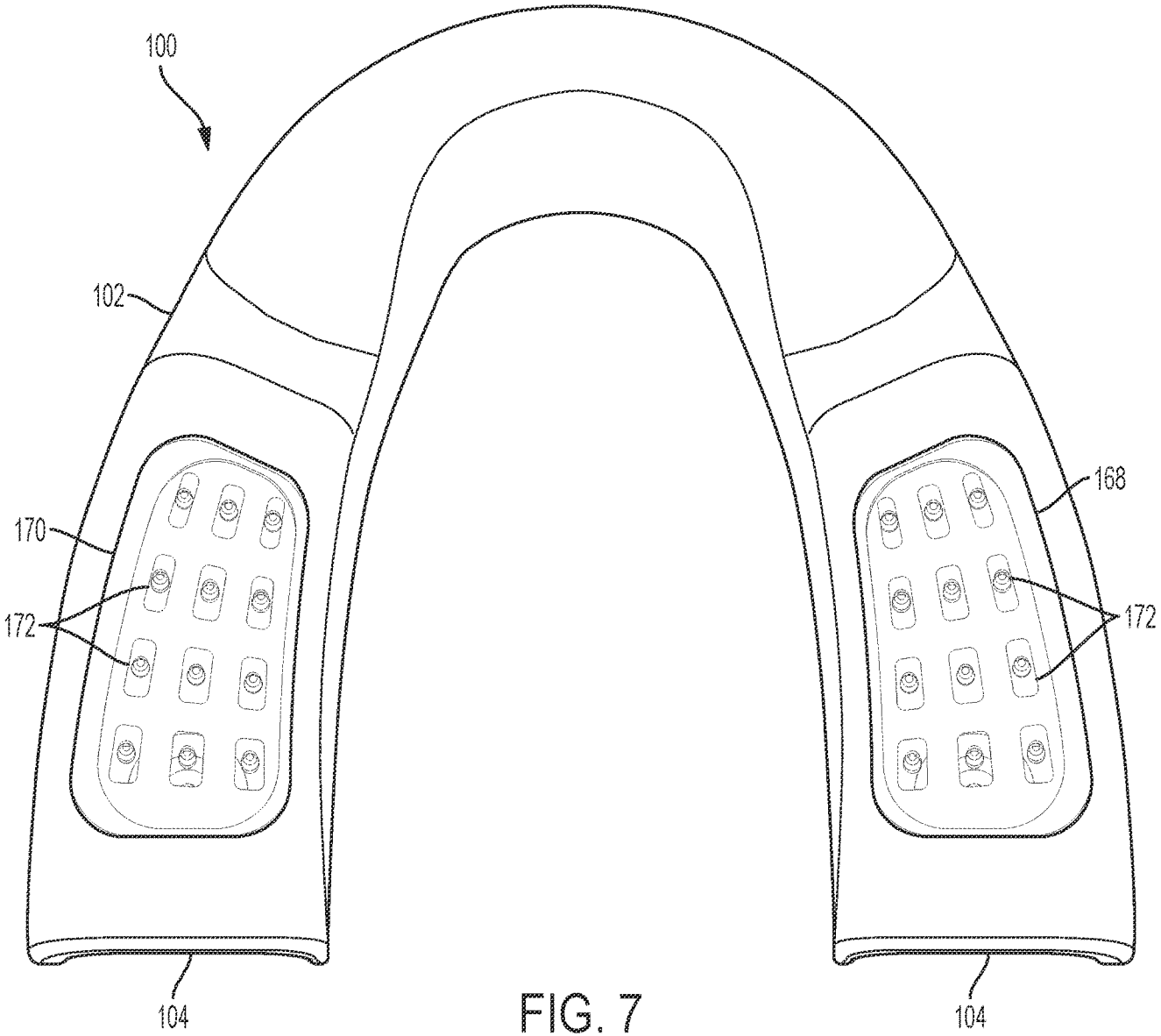
FIG. 7 is a bottom view of the mouthguard of FIG. 1.
Figure 8:
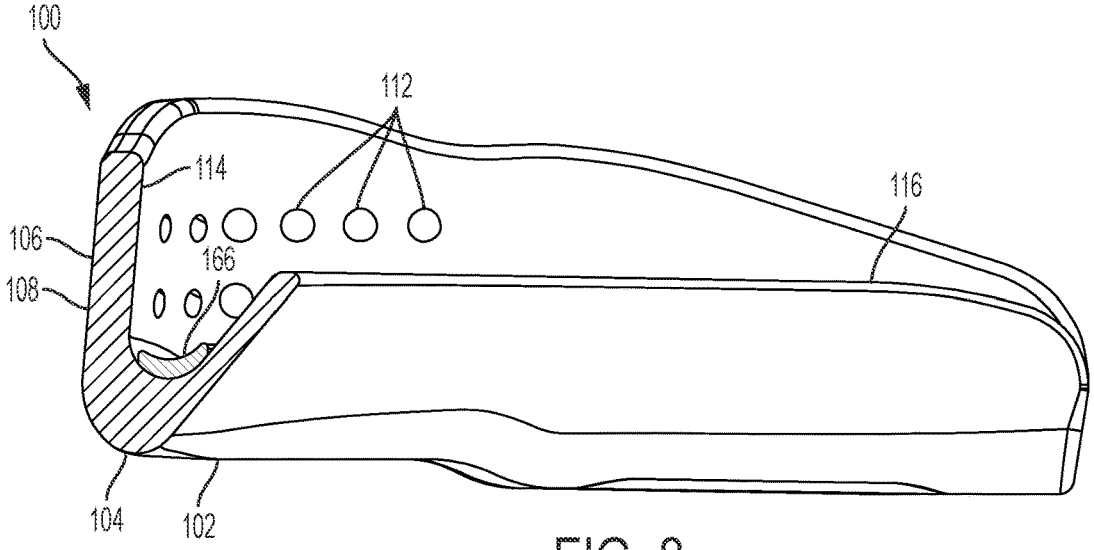
FIG. 8 is a sectional view of the mouthguard along line 8-8 of FIG. 6.
Figure 9:
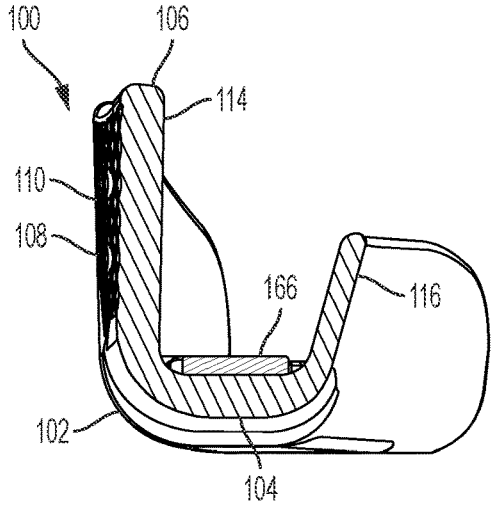
FIG. 9 is a sectional view of the mouthguard along line 9-9 of FIG. 6.
Figure 10:
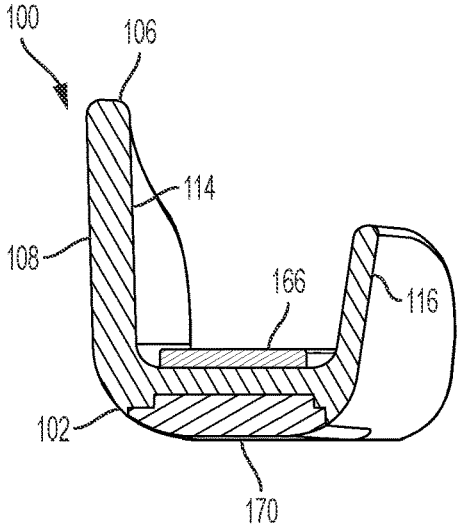
FIG. 10 is a sectional view of the mouthguard along line 10-10 of FIG. 6.
Figure 11:
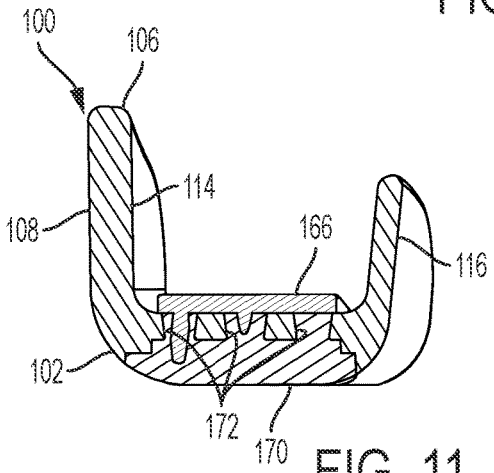
FIG. 11 is a sectional view of the mouthguard along line 11-11 of FIG. 6.

The through holes 112 may extend through the protection portion 106 in various directions. In some embodiments, some of the through holes 112 may extend through the protection portion 106 in anterior-posterior directions (for example, the through holes 112 in columns 142, 144, 146, 148, 150, and 152) and the remainder of the through holes 112 may extend through the protection portion 106 in medial-lateral directions (for example, the through holes 112 in columns 134, 136, 138, 140, 154, 156, 158, and 160). By extending in different directions through the protection portion 106, some of the through holes 112 may intersect at or near the interior surface 114 of the protection portion 106. For example and as shown in FIG. 3, the through holes 112 in columns 140 and 142 intersect at the interior surface 114, and the through holes 112 in columns 152 and 154 intersect at the interior surface 114.

In some embodiments, the occlusion portion 104 further includes one or more bite layers that are carried by the base 102 and facilitate fitting the mouthguard 100 to the wearer's mouth. For example and as shown in the figures, the occlusion portion 104 may include a superior bite layer 166, a left inferior bite layer 168, and a right inferior bite layer 170.

The superior bite layer 166 is configured to be engaged by at least some of the upper teeth of the wearer. The superior bite layer 166 may be coupled to the base 102 by extending into one or more through holes 172 and/or blind holes 174 formed in the base 102. In some embodiments, the superior bite layer 166 is formed of a relatively soft material compared to that of the base 102 to facilitate, for example, wearer comfort (due to the material of the superior bite layer 166) and wearer protection (due to the material of the base 102). Stated another way, in some embodiments the base 102 is formed of a first material and the superior bite layer 166 is formed of a second material that is different than the first material. In some embodiments, the first material has a greater hardness than the second material. For example, the first material and the second material may be the same polymer or different polymers having different hardness values. For example, the first material can be a low density thermoplastic rubber having a first hardness and the second material can be a low density thermoplastic rubber having a second hardness that is less than the first hardness. An example of a first material includes a thermoplastic rubber having a Shore A hardness of about 62. An example of a second material includes a thermoplastic rubber having a Shore A hardness of about 52 or less. In some embodiments, a ratio of the second hardness to the first hardness (that is, a value of the second hardness divided by a value of the first hardness) is about 90 percent or less, about 85 percent or less, between 80 percent and 90 percent, or about 50 percent or less. In some embodiments, the second hardness is greater than the first hardness.

In some embodiments, the first material and second material are selected to facilitate softening specific features of the mouthguard 100 when fitting the mouthguard 100 by using a "boil and bite" method. For example, the first material may soften at a temperature in a first temperature range, the second material may soften at a temperature in a second temperature range, and the second temperature range may be less than the first temperature range. As a specific example, the first temperature range may be about 140 to about 200 degrees Fahrenheit and the second temperature range may be about 100 to about 150 degrees Fahrenheit. As such, the mouthguard 100 may be immersed in boiling water, or heated non-boiling water, for a sufficient amount of time (for example, 16 to 60 seconds) to soften the superior bite layer 166 and the protection portion 106, due to the presence of the textured surface 110 and/or the through holes 112, without appreciably softening the remainder of the base 102. Stated another way, in some embodiments the protection portion 106 reaches a softening temperature before the remainder of the base 102 due to the presence of the textured surface 110 and/or the through holes 112. As another specific example, the first temperature range may be about 140 to about 200 degrees Fahrenheit and the second temperature range may include room temperature. In these embodiments, the mouthguard 100 is immersed in boiling water, or heated non-boiling water, to soften and facilitate fitting the protection portion 106, but the superior bite layer 166 is not appreciably further softened. Instead, the superior bite layer 166 elastically deforms to fit to the upper teeth of the wearer each time that the mouthguard 100 is placed in the wearer's mouth (that is, during the initial fitting and each time thereafter).

In some embodiments, the first material is polycaprolactone. In some embodiments, the first material is a thermoplastic rubber (TPR). In some embodiments, the first material is a copolymer of ethylene and vinyl acetate (EVA), for example, Elvax™ commercially available from DuPont. In some embodiments, the second material is TPR or EVA blended with a high molecular weight linear polyester derived from caprolactone monomer (for example, Capa™ 6800 commercially available from Perstorp) and, optionally, low linear weight polyethylene. In some embodiments, the first material includes at least about 80 percent by weight of the high molecular weight linear polyester derived from caprolactone monomer. In some embodiments, the first material includes about 100 percent by weight of the high molecular weight linear polyester derived from caprolactone monomer. In some embodiments, the first material includes about 1 percent EVA. In some embodiments, the first material includes about 10 percent of the low linear weight polyethylene. In some embodiments, the first material is a composite of EVA and an elastomeric material such as TPR or vulcanized rubber. In some embodiments, the polymer includes about 50 percent to about 80 percent by weight of the elastomeric material and about 20 percent to about 50 percent by weight of EVA. In some embodiments, the EVA copolymer can include vinyl acetate in the range of about 18 percent to about 28 percent by weight.

In some embodiments, the second material is EVA, for example, Elvax™. In some embodiments, the second material is EVA and has at least 33 percent of vinyl acetate by weight. In some embodiments, the second material is EVA and has at least 40 percent of vinyl acetate by weight. For example, a suitable second material is a soft EVA 40. Other suitable second materials are EVA 100 or EVA 150.

In some embodiments, the superior bite layer 166 is relatively thin (in a superior-inferior direction) compared to one or more features of the base 102. For example, the superior bite layer 166 may be relatively thin (to facilitate, for example, softening the second material) compared to the protection portion 106 (in a direction between the interior surface 114 and the exterior surface 108; to facilitate, for example, wearer protection). Stated another way, in some embodiments, the protection portion 106 has a first thickness between the interior surface 114 and the exterior surface 108, the bite layer has a second thickness that extends in a superior-inferior direction, and the first thickness is greater than the second thickness. For example, the first thickness is in a range from 150 percent to 50 percent greater than the second thickness, the first thickness is in a range from 130 percent to 70 percent greater than the second thickness, or the first thickness is in a range from 110 percent to 90 percent greater than the second thickness. In some embodiments, the first thickness is less than the second thickness. For example, the first thickness is in a range from 150 percent to 50 percent less than the second thickness, the first thickness is in a range from 130 percent to 70 percent less than the second thickness, or the first thickness is in a range from 110 percent to 90 percent less than the second thickness. In some embodiments, the first thickness and the second thickness are selected to provide a desired closeness of fit.

The left inferior bite layer 168 and the right inferior bite layer 170 are configured to be engaged by at least some of the lower teeth of the wearer (for example, the left lower molars and the right lower molars, respectively). The inferior bite layers 168 and 170 may be coupled to the base 102 by extending into one or more of the through holes 172 formed in the base 102. In some embodiments, the inferior bite layers 168 and 170 are formed of a relatively soft material compared to the first material of the base 102 to facilitate, for example, wearer comfort. Stated another way, in some embodiments the inferior bite layers 168 and 170 are formed of a third material that is different than the first material of the base 102. In some embodiments, the third material has a lower hardness than the first material. For example, the first material and the third material may be the same polymer or different polymers having different hardness values. For example, the first material has a first hardness and may be any of the materials described above, and the third material can be a low density thermoplastic rubber having a third hardness that is less than the first hardness. An example of a third material includes a thermoplastic rubber having a Shore A hardness of about 52 or less. In some embodiments, a ratio of the third hardness to the first hardness (that is, a value of the third hardness divided by a value of the first hardness) is about 90 percent or less, about 85 percent or less, or between 80 percent and 90 percent. In some embodiments, the third hardness is greater than the first hardness.

In some embodiments, the first material and third material are selected to facilitate softening specific features of the mouthguard 100 when fitting the mouthguard 100 by using a boil and bite method. For example, the first material may soften at a temperature in a first temperature range, the third material may soften at a temperature in a third temperature range, and the third temperature range may be less than the first temperature range. As a specific example, the first temperature range may be about 140 to about 200 degrees Fahrenheit and the third temperature range may be about 100 to about 150 degrees Fahrenheit. As such, the mouthguard 100 may be boiled for a sufficient amount of time (for example, 16 to 60 seconds) to soften the inferior bite layers 168 and 170 and the protection portion 106, due to the presence of the textured surface 110 and/or the through holes 112, without appreciably softening the remainder of the base 102. As another specific example, the first temperature range may be about 140 to about 200 degrees Fahrenheit and the third temperature range may include room temperature. In these embodiments, the mouthguard 100 is boiled to soften and facilitate fitting the protection portion 106, but the inferior bite layers 168 and 170 are not appreciably further softened. Instead, the inferior bite layers 168 and 170 elastically deform to fit to the lower teeth of the wearer each time that the mouthguard 100 is placed in the wearer's mouth (that is, during the initial fitting and each time thereafter).

Examples of the first material are described above. In some embodiments, the third material is a TPR, for example, DuraGrip™ commercially available from Advanced Polymer Alloys or one of those commercially available from Kraton Performance Polymers. In some embodiments, the third material is EVA and has at least 33 percent of vinyl acetate by weight. In some embodiments, the third material is EVA and has at least 40 percent of vinyl acetate by weight. For example, a suitable third material is a soft EVA 40. Other suitable third materials are EVA 100 or EVA 150. In some embodiments, the third material is EVA. In some embodiments, the third material is a high molecular weight linear polyester derived from caprolactone monomer (for example, Capa™ 6800). In some embodiments, the third material is polypropylene.

In embodiments in which the mouthguard 100 includes one or more inferior bite layers 168 and 170 and the superior bite layer 166, the third material and the second material may be the same polymer or different polymers having different hardness values and softening temperatures.

In some embodiments, the inferior bite layers 168 and 170 are relatively thin (in a superior-inferior direction) compared to one or more features of the base 102. For example, the inferior bite layers 168 and 170 may be relatively thin (to facilitate, for example, softening the third material as described above) compared to the protection portion 106 (to facilitate, for example, wearer protection). Stated another way, in some embodiments, the protection portion 106 has a first thickness between the interior surface 114 and the exterior surface 108, the inferior bite layers 168 and 170 have a third thickness that extends in a superior-inferior direction, and the first thickness is greater than the third thickness. For example, the first thickness is in a range from 150 percent to 50 percent greater than the third thickness, the first thickness is in a range from 130 percent to 70 percent greater than the third thickness, or the first thickness is in a range from 110 percent to 90 percent greater than the third thickness. In some embodiments, the first thickness is less than the third thickness. For example, the first thickness is in a range from 150 percent to 50 percent less than the third thickness, the first thickness is in a range from 130 percent to 70 percent less than the third thickness, or the first thickness is in a range from 110 percent to 90 percent less than the third thickness.

Figure 12:
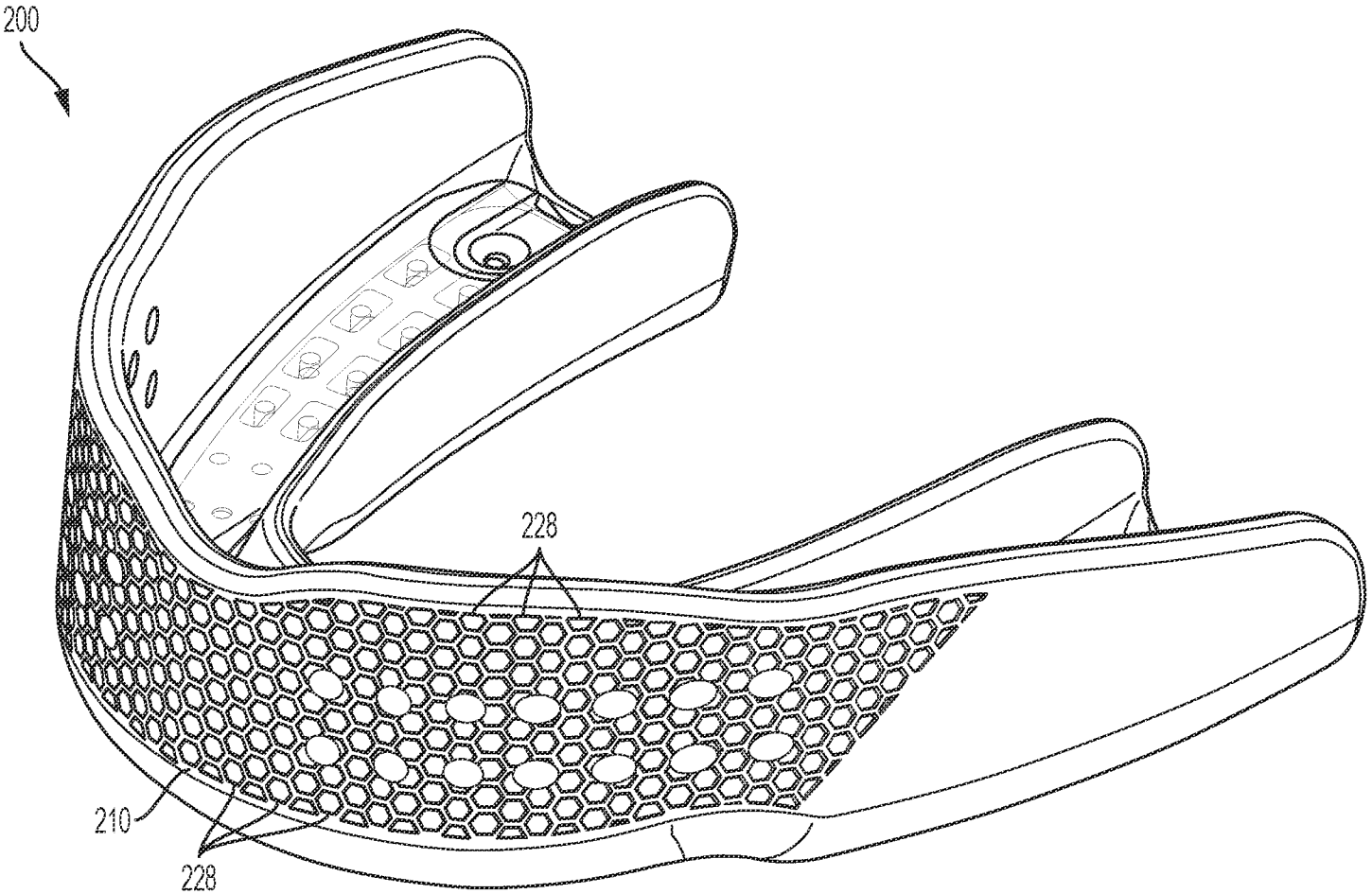
FIG. 12 is a perspective view of a mouthguard, according to some embodiments of the present disclosure.
Figure 13:
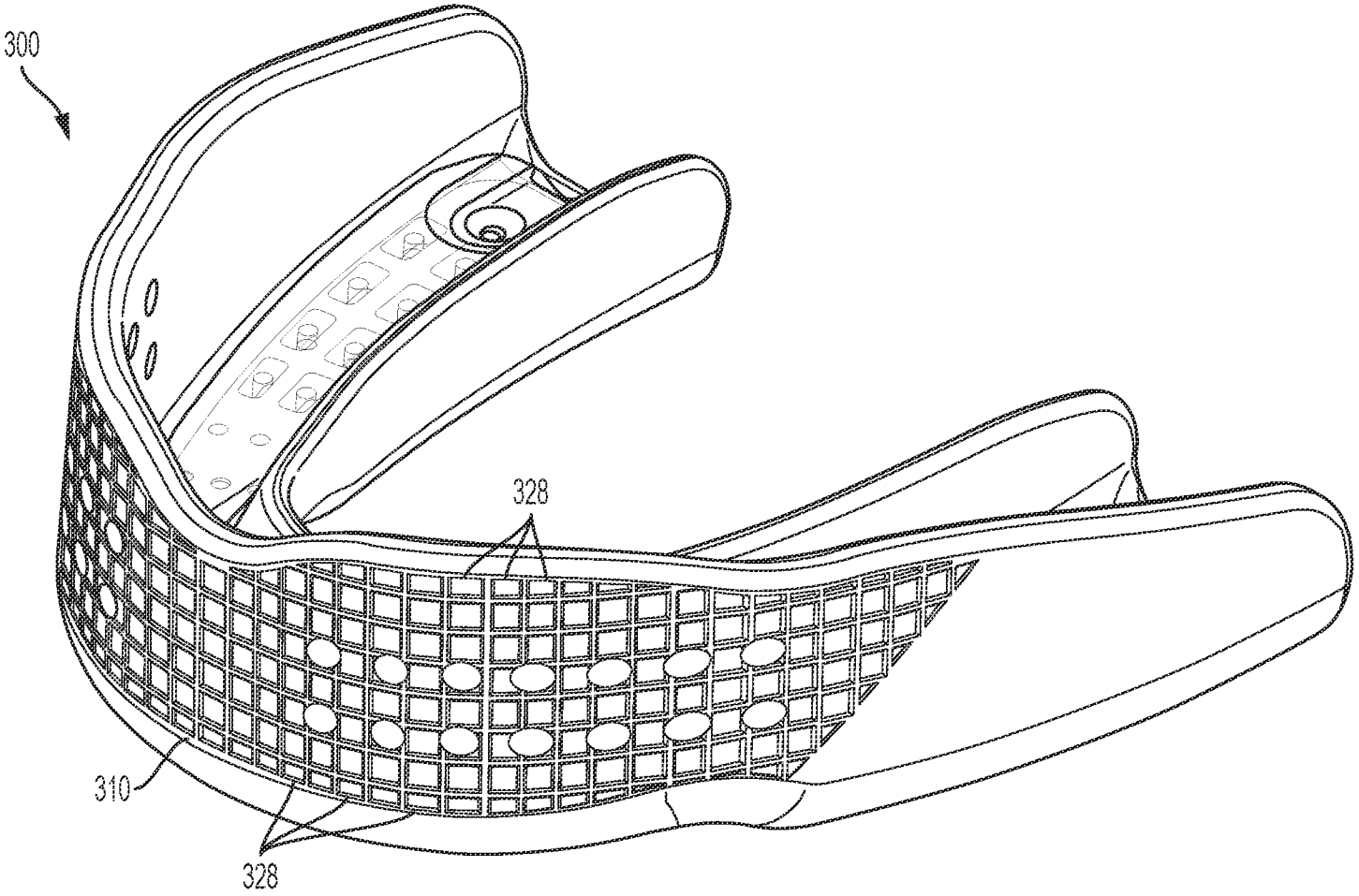
FIG. 13 is a perspective view of a mouthguard, according to some embodiments of the present disclosure.
Figure 14:
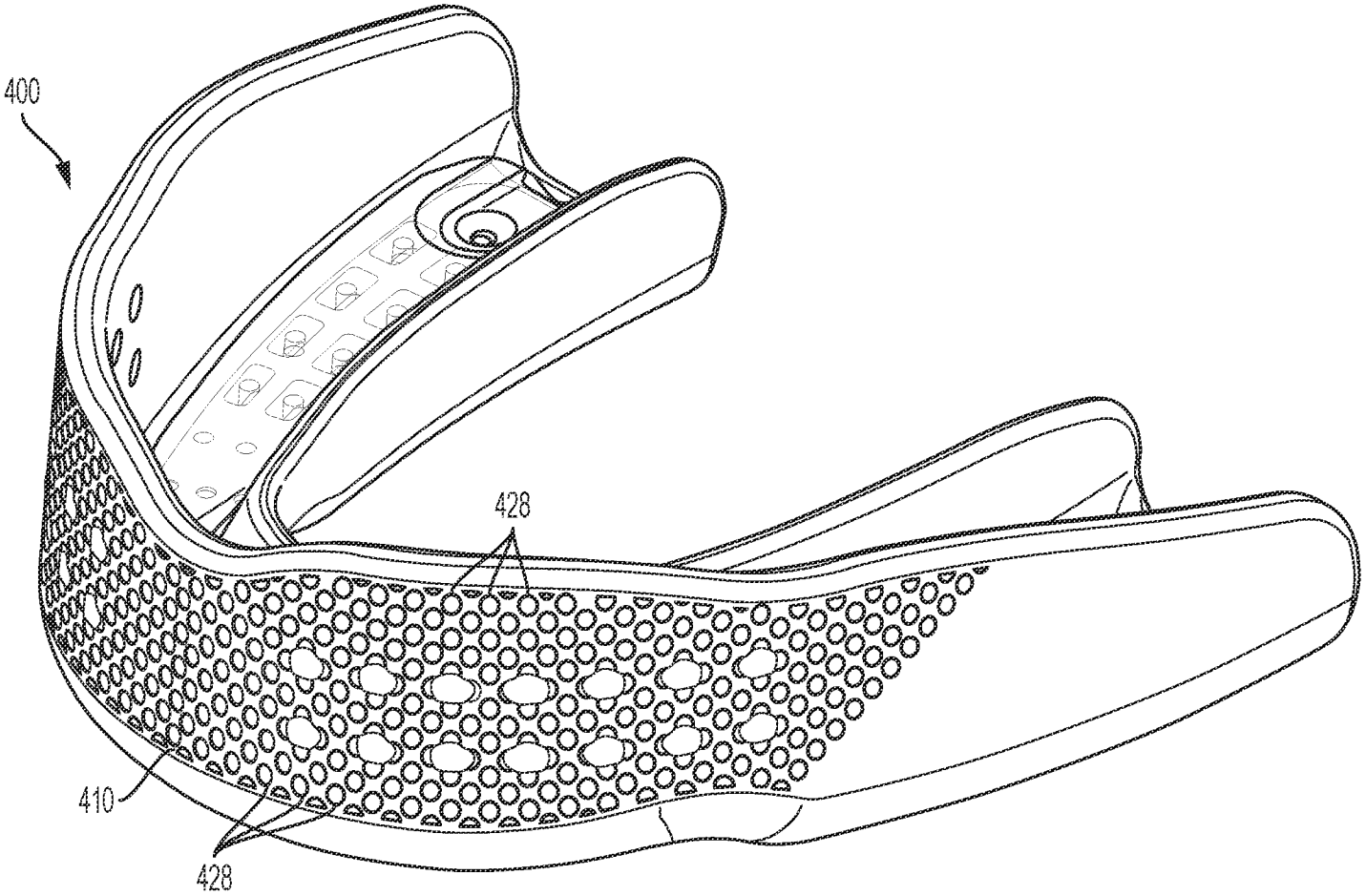
FIG. 14 is a perspective view of a mouthguard, according to some embodiments of the present disclosure.

As described briefly above, textured surfaces of mouthguards according to some embodiments of the present disclosure may include a plurality of recesses that have a variety of shapes. FIGS. 12-14 illustrate exemplary embodiments of such mouthguards. Specifically, FIG. 12 illustrates a mouthguard 200 according to some embodiments of the present disclosure. In some embodiments, the mouthguard 200 includes the same features as the mouthguard 100, except the textured surface 210 includes a plurality of hexagon-shaped recesses 228. In some embodiments, the hexagon-shaped recesses 228 each have a maximum diameter (that is, the distance between opposite vertices) of about 1.5 mm (that is, 1.5 mm±0.3 mm). FIG. 13 illustrates a mouthguard 300 according to some embodiments of the present disclosure. In some embodiments, the mouthguard 300 includes the same features as the mouthguard 100, except the textured surface 310 includes a plurality of square-shaped recesses 328. In some embodiments, the square-shaped recesses 328 each have side lengths of about 1.5 mm (that is, 1.5 mm±0.3 mm). FIG. 14 illustrates a mouthguard 400 according to some embodiments of the present disclosure. In some embodiments, the mouthguard 400 includes the same features as the mouthguard 100, except the textured surface 410 includes a plurality of circular recesses 428. In some embodiments, the circular recesses 428 each have a diameter of about 1.5 mm (that is, 1.5 mm±0.3 mm).

Textured surfaces of mouthguards according to embodiments of the present disclosure, including the textured surfaces having recesses as described above, may have a relatively rough surface finish (in terms of surface roughness, waviness, and/or lay) compared to one or more of the other surfaces. In some embodiments the textured surface may have a first waviness, a smooth surface (such as any of the smooth surfaces described above) may have a second waviness, and the second waviness may be less than the first waviness. More specifically, in some embodiments the textured surface may have a first waviness height and a first waviness spacing, a smooth surface may have a second waviness height and a second waviness spacing, the second waviness height may be less than the first waviness height, and the second waviness spacing may be less than the first waviness spacing. For example, the first waviness height may be greater than or equal to about 0.3 mm and the second waviness height may be less than about 0.3 mm, the first waviness height may be greater than or equal to about 0.6 mm and the second waviness height may be less than about 0.6 mm, or the first waviness height may be greater than or equal to about 1.0 mm and the second waviness height may be less than about 1.0 mm. As another example, the first waviness spacing may be greater than or equal to about 0.5 mm and the second waviness spacing may be less than about 0.5 mm, the first waviness spacing may be greater than or equal to about 1.0 mm and the second waviness spacing may be less than about 1.0 mm, or the first waviness spacing may be greater than or equal to about 1.5 mm and the second waviness spacing may be less than about 1.5 mm. The textured surface may have, for example, a cross-hatched lay (that is, the lay is in both directions along the surface). The smooth surface may have, for example, a particulate lay (that is, a non-directional lay).

Mouthguards according to some embodiments of the present disclosure may differ from those described above in various other manners. For example, in some embodiments a mouthguard may lack a bite layer, and the occlusion portion of the base may be relatively thin (in a superior-inferior direction) compared to the protection portion (between the exterior surface and the interior surface). Such an occlusion portion may facilitate fitting the mouthguard to the wearer's mouth in the absence of a bite layer.

As briefly described above, in some embodiments mouthguards according to the present disclosure are fitted to the mouth of the wearer before use during athletic activities. In some cases, mouthguards according to the present disclosure are momentarily submersed into boiling water (for example, for a time period of about 16-60 seconds). This causes one or more portions of the mouthguard to soften (for example, the protection portion and/or the bite layers) without appreciably softening the remainder of the mouthguard (for example, the occlusion portion of the base). Thereafter, the mouthguard is immediately placed onto the wearer's teeth. The wearer bites down firmly and applies suction between the upper jaw and the mouthguard while packing the mouthguard with the hands along the cheeks and gums adjacent the front and rear teeth of the upper jaw.

In some embodiments, any of the properties described herein (for example, hardness, surface roughness, waviness, and lay) may be measured using available ISO/ASTM standards or other test methods commonly associated with such metrics. For example, surface finishes may be measured according to the ASME Y14.36M standard. This standard may be used to measure, for example, the first waviness height and/or first waviness spacing of a textured surface and the second waviness height and/or second waviness spacing of a smooth surface.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed:

1. A mouthguard comprising:

an occlusion portion configured to be disposed between and engaged between at least some of the teeth of a wearer, the occlusion portion comprising:

a base comprising a first material having a first hardness;

an inferior bite layer coupled to the base by extending into one or more through holes formed in the base and configured to be engaged by at least some of the lower teeth of the wearer, the inferior bite layer comprising a second material having a second hardness, the second hardness being greater than the first hardness;

a protection portion coupled to the occlusion portion, the protection portion configured to be disposed laterally and anteriorly relative to the teeth of the wearer, the protection portion comprising:

an interior surface configured to face toward the teeth of the wearer; and an exterior surface opposite the interior surface and configured to face away from the teeth of the wearer.

2. The mouthguard of claim 1, wherein the inferior bite layer is a right inferior bite layer configured to be engaged by the right lower molars of the wearer, and further comprising a left inferior bite layer configured to be engaged by the left lower molars of the wearer.

3. The mouthguard of claim 2, wherein the base comprises a lower surface disposed between the right inferior bite layer and the left inferior bite layer, the lower surface configured to be engaged by the lower teeth of the wearer.

4. The mouthguard of claim 1, wherein the protection portion has a first thickness between the interior surface and the exterior surface, the inferior bite layer has a second thickness extending in a superior-inferior direction, and the first thickness is greater than the second thickness.

5. The mouthguard of claim 4, wherein the first thickness is in a range from 150 percent to 50 percent greater than the second thickness.

6. The mouthguard of claim 1, wherein the protection portion comprises the first material.

7. The mouthguard of claim 1, wherein the second material comprises a copolymer of ethylene and vinyl acetate (EVA).

8. The mouthguard of claim 1, wherein the second material comprises a thermoplastic rubber.

9. The mouthguard of claim 1, wherein the second material comprises polypropylene.

10. The mouthguard of claim 1, wherein the second material comprises a high molecular weight linear polyester derived from caprolactone monomer.

11. The mouthguard of claim 1, wherein the second material comprises polypropylene.

12. The mouthguard of claim 1, wherein the protection portion further comprises a plurality of through holes extending from the interior surface to the exterior surface.

13. The mouthguard of claim 1, wherein the first material comprises polycaprolactone.

14. The mouthguard of claim 1, wherein at least a portion of the exterior surface is a textured surface.

15. A mouthguard comprising:

an occlusion portion configured to be disposed between and engaged between at least some of the teeth of a wearer, the occlusion portion comprising:

a base comprising a first material having a first hardness;

an inferior bite layer coupled to the base and configured to be engaged by at least some of the lower teeth of the wearer, the inferior bite layer comprising a second material having a second hardness, the second hardness being greater than the first hardness;

a superior bite layer coupled to the base and configured to be engaged by at least some of the upper teeth of the wearer;

a protection portion coupled to the occlusion portion, the protection portion configured to be disposed laterally and anteriorly relative to the teeth of the wearer, the protection portion comprising:

an interior surface configured to face toward the teeth of the wearer; and an exterior surface opposite the interior surface and configured to face away from the teeth of the wearer.

16. The mouthguard of claim 15, wherein the superior bite layer comprises a third material having a third hardness, the third hardness being different than the first hardness.

17. The mouthguard of claim 16, wherein the third hardness is greater than the first hardness.

18. The mouthguard of claim 16, wherein the third material comprises a copolymer of ethylene and vinyl acetate (EVA).

19. The mouthguard of claim 15, wherein the protection portion has a first thickness between the interior surface and the exterior surface, the superior bite layer has a second thickness extending in a superior-inferior direction, and the first thickness is greater than the second thickness.

20. The mouthguard of claim 19, wherein the first thickness is in a range from 150 percent to 50 percent greater than the second thickness.

* * * * *